US010577171B2

(12) United States Patent
Glasgow

(10) Patent No.: US 10,577,171 B2
(45) Date of Patent: Mar. 3, 2020

(54) TACTILE MANIPULATION TOOL

(71) Applicant: Ryan William Glasgow, Portland, OR (US)

(72) Inventor: Ryan William Glasgow, Portland, OR (US)

( * ) Notice: Subject to any disclaimer, the term of this patent is extended or adjusted under 35 U.S.C. 154(b) by 189 days.

(21) Appl. No.: 15/970,305

(22) Filed: May 3, 2018

(65) Prior Publication Data

US 2018/0319577 A1 Nov. 8, 2018

Related U.S. Application Data

(60) Provisional application No. 62/501,225, filed on May 4, 2017.

(51) Int. Cl.
*B25H 3/00* (2006.01)
*B65D 85/20* (2006.01)

(52) U.S. Cl.
CPC ..... *B65D 85/20* (2013.01); *B25H 3/003* (2013.01)

(58) Field of Classification Search
CPC . B25H 3/00; B25H 3/04; B25H 3/003; B65D 85/20
USPC ..... 206/379
See application file for complete search history.

(56) References Cited

U.S. PATENT DOCUMENTS 8,950,597 B2 * 2/2015 Lin ..... B25H 3/003 206/376
2012/0312710 A1 * 12/2012 Sun ..... B25H 3/003 206/373

* cited by examiner

*Primary Examiner* — King M Chu
(74) *Attorney, Agent, or Firm* — Mark S Hubert

(57) ABSTRACT

A tactile manipulation device comprised of at least one bent axle rod, a series of revolve rods, two substantially similar barrel housings and at least two retaining means. The embodiments differ in the geometric design of the barrel housings, the number of revolve rods, the angle of the bends in the rods, the number and style of retaining means used to lock the axle rod in the barrel housings. This series of similarly bent revolve rods are rotationally and removeably contained adjacent their distal and proximal ends within C-shaped channels formed parallel to the centerline in a pair of identical barrel housings. The ends of the revolve rods have mechanical tool bits thereon.

10 Claims, 10 Drawing Sheets

20

21

22

FIG 26
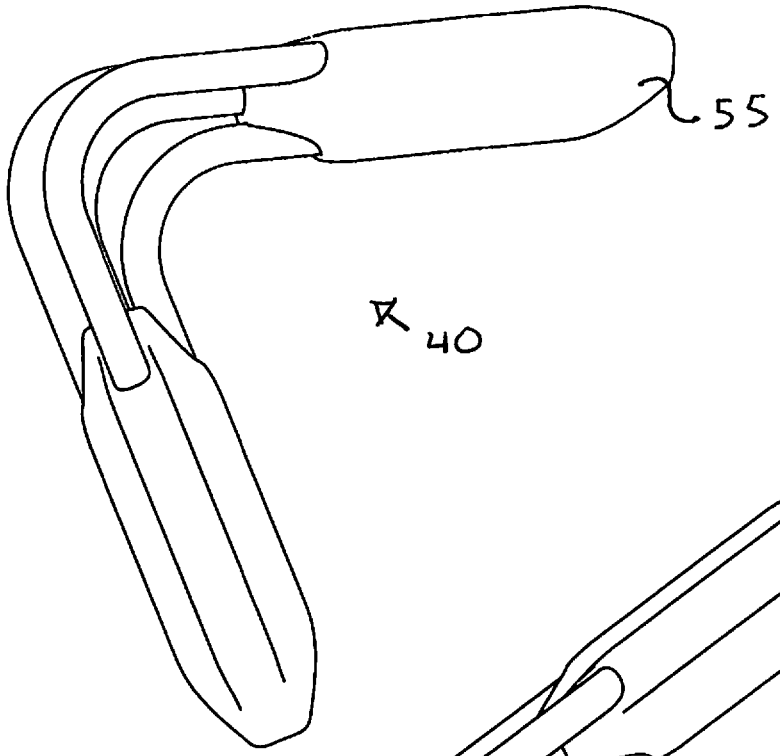
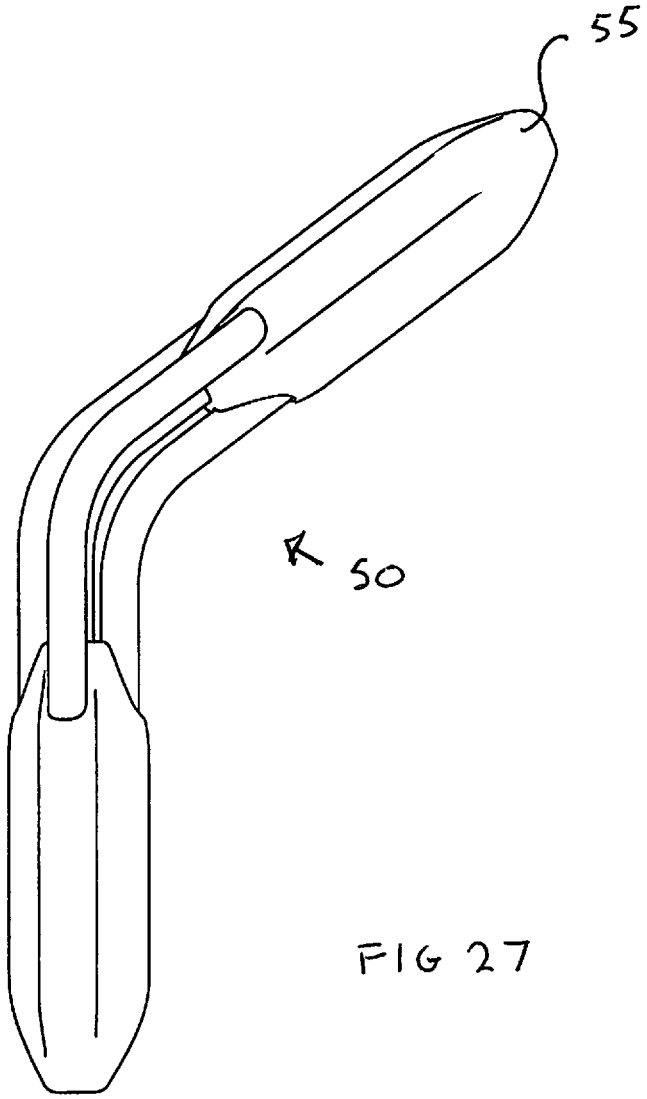
FIG 27

TACTILE MANIPULATION TOOL

CLAIM FOR DOMESTIC PRIORITY

This application incorporates in its entirety, and claims the benefit of priority from pending U.S. Utility Patent Application No. 62/501,225 filed May 4, 2017 and entitled "Tactile Manipulation Toy."

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a tactile manipulation device intended for use as a tool. It may be incorporated into the mechanics of another tool such as a knife or it may be a standalone part of a mechanical tool kit, or it may be as simple as a conversational object intended to be left in ready access.

BACKGROUND

There is always a need for a tactile device "you just can't put down." These commonly find themselves on people's desks, doubling as a paperweight. They serve as a device people use to pass time manipulating, to ponder, to relieve boredom with or play with as a form of stress relief. The multi colored Rubic's Cube™ is an example thereof.

Generally, these devices need to be strong as they see a lot of manipulations, durable, freely and smoothly manipulable and inexpensive. To find all of these qualities in such a device is hard. Most importantly, the device has to call out to the user to be touched—primarily because it peaks their curiosity. To garner this quickly, it has to seem to defy their understanding of the laws of science or nature. Only then will they reach out and seek to manipulate it as they try to understand its secret of operation.

However, people do bore with just repeated tactile manipulation. Not everyone will purchase a tactile manipulation device. However, incorporate a set of commonly used mechanical tools with this and you have given the consumer a reason to purchase. Lastly, if the tactile manipulation device offers a organizing storage solution for this set of common tools as well, the chances of the consumer making this purchase is greatly elevated. Thus, an inexpensive, durable, manipulative device having a useful purpose beside quickly gaining the interest of a person upon visual presentation is provided by the embodiments set forth below.

BRIEF SUMMARY

In accordance with the following description, an apparatus configurable into several physical embodiments, potentially all being able to be incorporated into a system or kit for tactile mechanical assembly is provided.

In one aspect, a series of similarly bent rods, rotationally contained adjacent their distal and proximal ends by a pair of identical barrel housings is provided. The barrel housings may partially encapsulate a section of the bent rods, (not necessarily equidistant from the midpoint of the bend) or it may extend over the ends of the rods. One of the series of bent rods is rotationally pinned in each of the two barrel housings preventing axial movement of it within the barrel housing.

In another aspect, a toy capable of rapidly generating visual intrigue to a person to the point of the urge for tactile manipulation is provided.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIGS. 26 and 27 are rear perspective views of a tactile manipulation device formed at acute and obtuse angles.

DETAILED DESCRIPTION OF CERTAIN EMBODIMENTS

Figure 1:
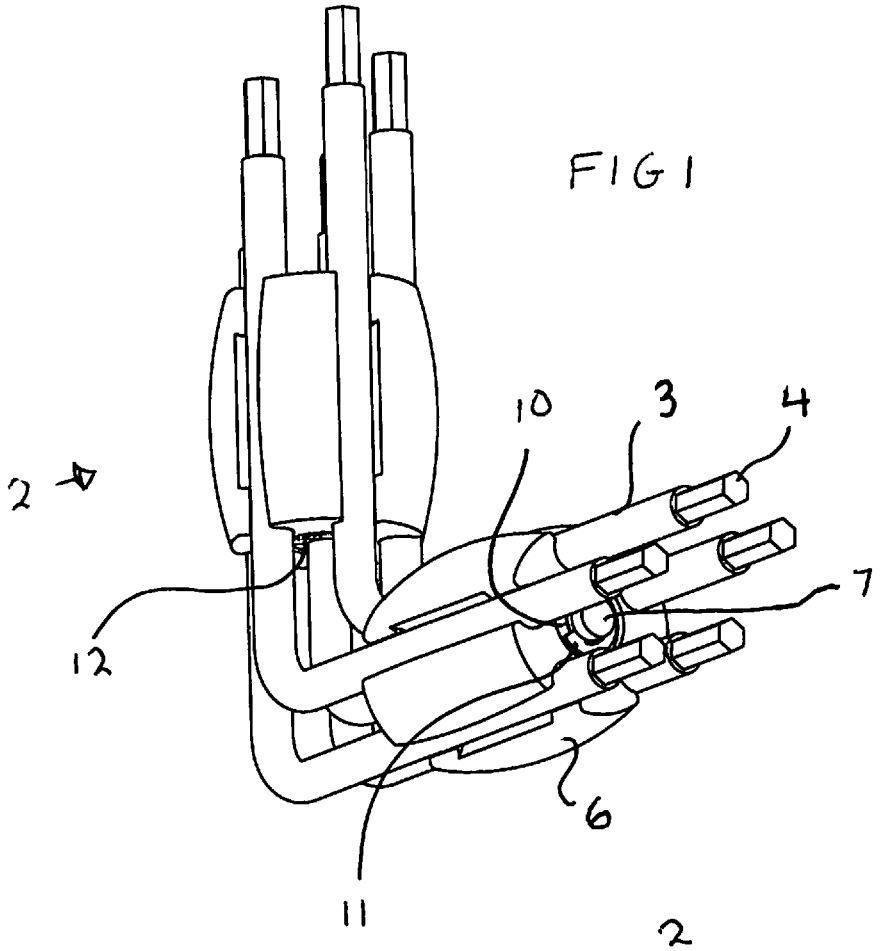
FIGS. 1 and 2 are front and rear perspective views of a first embodiment tool with a hex wrench set.
Figure 2:
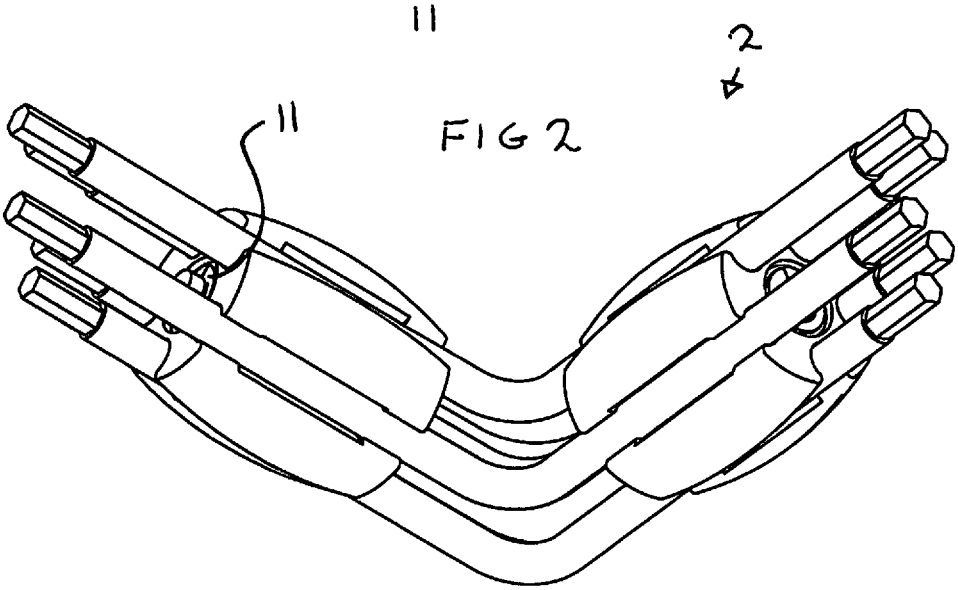
Figure 3:
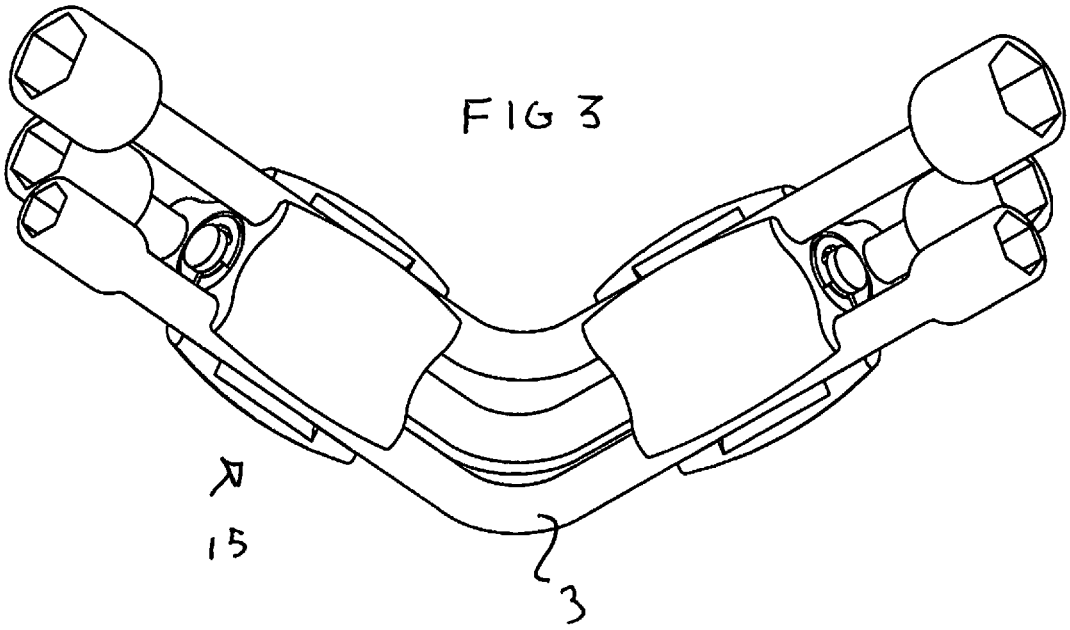
FIGS. 3 and 4 are front and rear perspective views of a second embodiment tool with a socket set.
Figure 4:
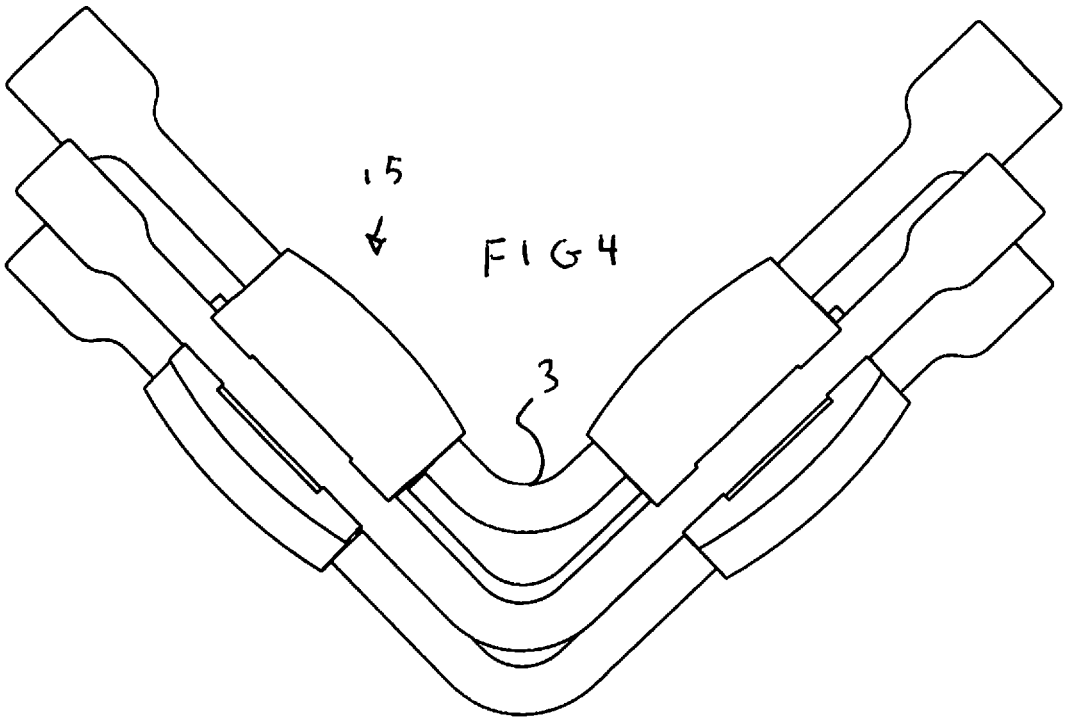
Figure 5:
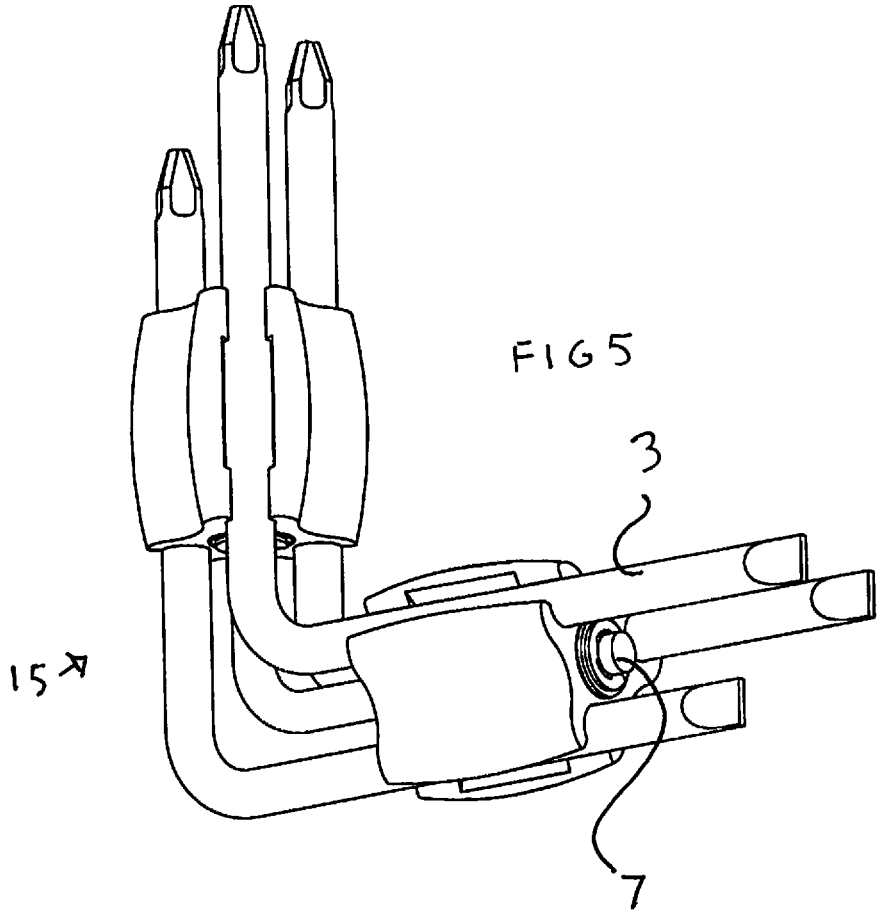
FIGS. 5 and 6 are front nd rear perspective views of a second embodiment tool with a screwdriver set.
Figure 6:
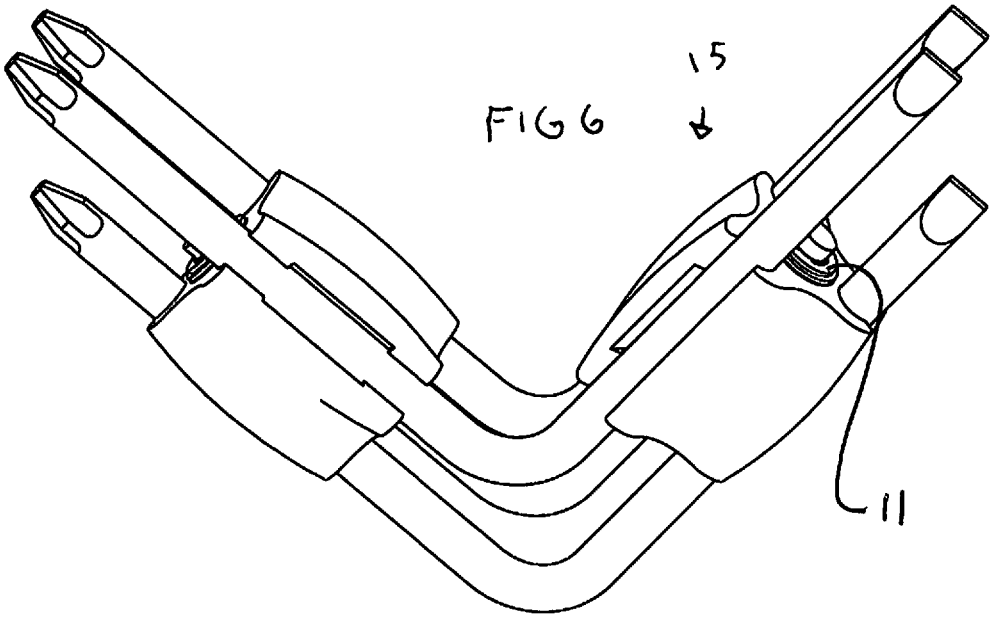

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The present invention relates to a novel design for a tactile manipulation device that may be used as a tool or a toy, comprised of at least one bent rod (pin) two substantially similar barrel housings and two or four axle pins. The embodiments differ in the geometric design of the barrel housings, the number of revolve rods, the angle of the bends in the rods, the end configurations of the bent rods (screwdriver, hex bit or socket), the number and style of axle pins used to affix the pivot rod in the barrel housings, and whether the revolve rods are removable or not.

As used herein, the term "bent rod" refers to a round cylindrical linear member that is bent, preferably at its approximate midpoint regardless of its diameter, cross sectional geometry, length or end configuration. (The term rod and pin are used interchangeably and refer to only the difference in diameter of these two elements.) The bent rods may be either revolve rods or axle rods.

As used herein, the term "barrel housing" refers to a generally cylindrical body with a series of parallel bores formed there through. These bores are generally parallel to the linear axis of the barrel housing.

As used herein the term "axle pin" refers to a mechanical means for locking the linear travel of one of the rods (generally the axle rod) within a barrel housing. The axle pins are connected between the barrel housing and the bent rod that is designated the axle rod. The axle pin does allow for the rotational movement of the axle rod relative to the bore in the barrel housing.

As used herein, the term "axle rod" refers to the single bent rod which has been designated as the bent rod around which the remaining bent rods in the series of bent rods that are in that embodiment, revolve around. It need not be central.

As used herein, the term "retaining means" refers to any of the various styles of mechanical devices used to constrain the barrel housings about the rods (axle or revolve). In the preferred embodiment these are what is commonly called "circlips" which are retaining rings generally of the style known in the industry as snap rings, E-clips, expanding internal rings, expanding external rings, or the equivalent.

The tactile manipulation device, in any of its embodiments, allow the barrel housings to revolve about an axle rod and the revolve rods to rotate within the barrel housings in an enjoyable tactile experience.

Looking at FIGS. 1, 2, 12 to 15, it can be seen that the first embodiment tool 2 has a series of bent revolve rods 3 with tool tips 4 inserted into the five parallel, expandable C-shaped channels 5 of both of the first embodiment barrel housings 6. These channels are equally axially spaced around the midpoint of the barrel housing. (This may or may not be aligned with the axle bore 8 as discussed further herein.) These channels 5 have their open throats arranged equidistant from adjacent channels and about the periphery of the barrel housing. They are equally axially spaced about the centerline of the barrel housing. The two substantially similar first embodiment barrel housings 6 are rotatable about a bent axle rod 7 that is affixed in a through axle bore 8 in the barrel housing 6. This axle bore 8 is parallel to the C-shaped channels 5 and centrally located through the centerline of the barrel housing 6. At either end of the barrel housing there is an end retaining means (circlip) recess 9 formed. At each end of the axle rod 7 are end retaining means (circlip) grooves 10. Between the end retaining means grooves on the axle rod are two intermediary retaining means (circlip) grooves 12. The intermediary retaining means grooves 12 are separated from the end retaining means grooves 10 by the length of the barrel housings. The axle through bore 8 has an internal diameter that approximates the external diameter of the axle rod 7 such that these two components may engage in frictional rotation relative to each other.

It is to be noted that the revolve rods 3 and the axle rod 7 are cylindrical rods, preferably having a circular cross section. However, in other embodiments these rods may utilize another cylindrical cross section such as a square, a pentagon, hexagon, octagon etc. if a sleeve that has a matingly conformed internal recess and a circular outer configuration is placed between the rod and the barrel housing.

To install the axle rod 7 in the two barrel housings, a pair of retaining means (circlips preferably) 11 are set into the intermediary circlip grooves 12. The ends of the axle rods 7 are frictionally slid through the two barrel housings and another pair of circlips 11 are affixed in the end circlip grooves 10. In this way the barrel housings are locked onto the ends of the axle rods 7, yet free to rotate. The axle rod 7 and the revolve rods 3 are all bent at the same angle. Preferably this is a right angle, although embodiments may utilize acute angles 40 as illustrated in FIG. 26 or obtuse angles 50 as illustrated in FIG. 27.

To install the revolve rods 3 their linear axis need be aligned with the liner axis of both of the barrel housings and the rods 3 laid in the open throat of the C-shaped channels 5. There is then a force pressing the revolve rod 3 past the throat and elastically deforming the barrel housing to allow the passage of the rod 3 into the center of the C-shaped channels where it is constrained, yet allowed to rotate.

Looking at FIGS. 3, 4 to 6, 10, 11, 16 and 17 it can be seen that this second embodiment tool 15 differs from the first embodiment tool 2 in that it uses a second embodiment barrel housing 16 with three rather than five expandable C-shaped channels 5. All embodiments of the barrel housings are elastically deformable so as to allow the repeated, removable insertion of the revolve rods 3. Generally, the barrel housing will be made of a resilient polymer.

Figures 7, 8, 9:
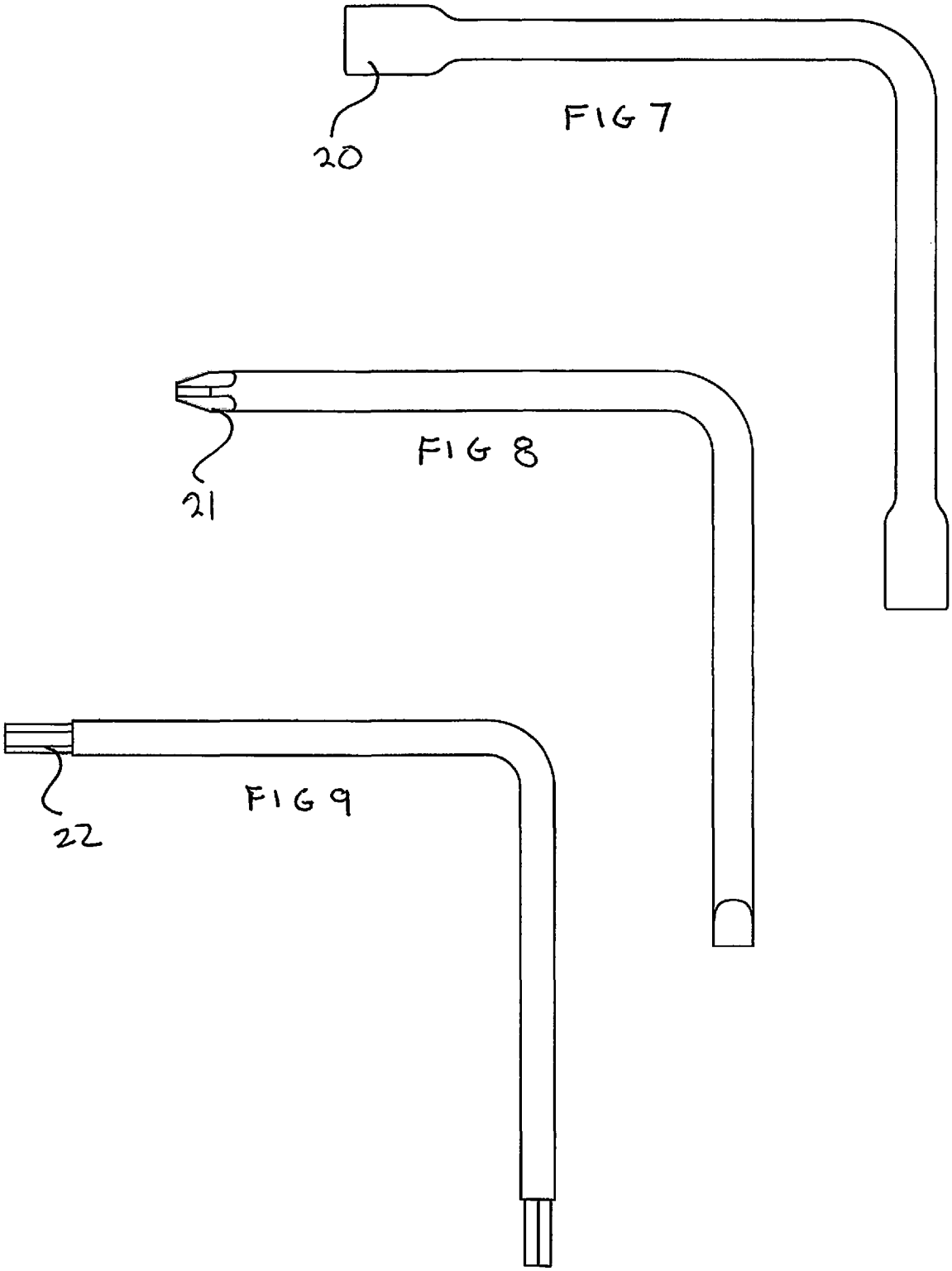
FIGS. 7-9 show side views of the removable socket wrench, screwdriver and hex wrench.
Figure 10:
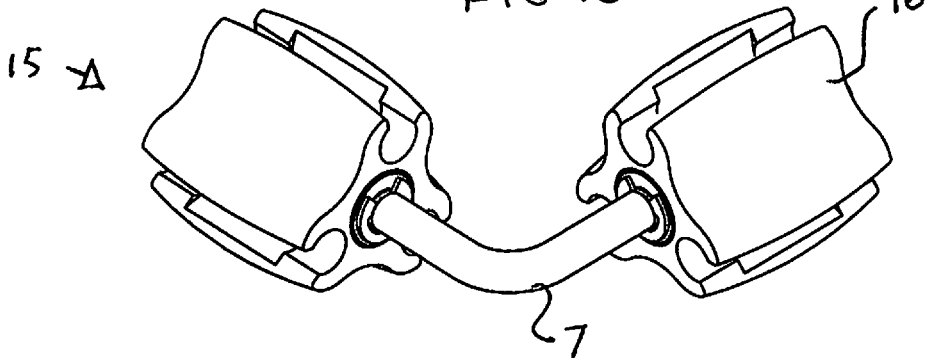
FIGS. 10 and 11 are front and rear perspective views of the second embodiment tool.
Figure 11:
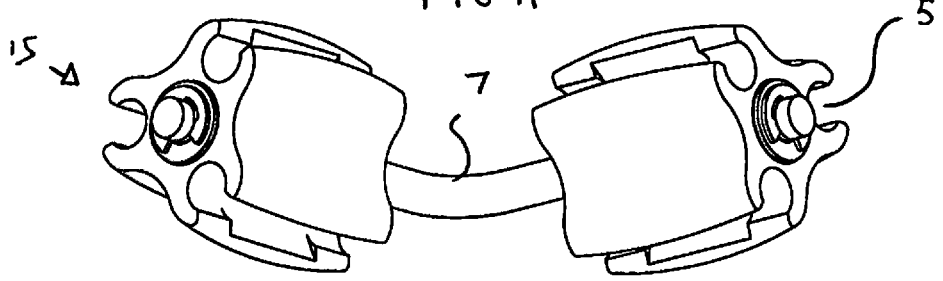
Figure 12:
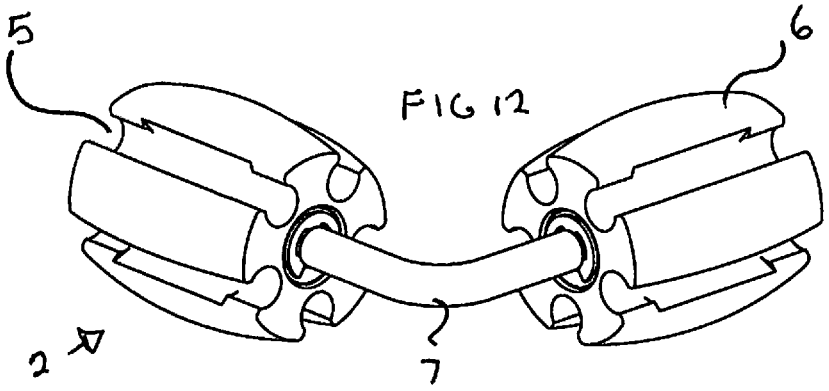
FIGS. 12 and 13 are front and rear perspective views of the first embodiment tool.
Figure 13:
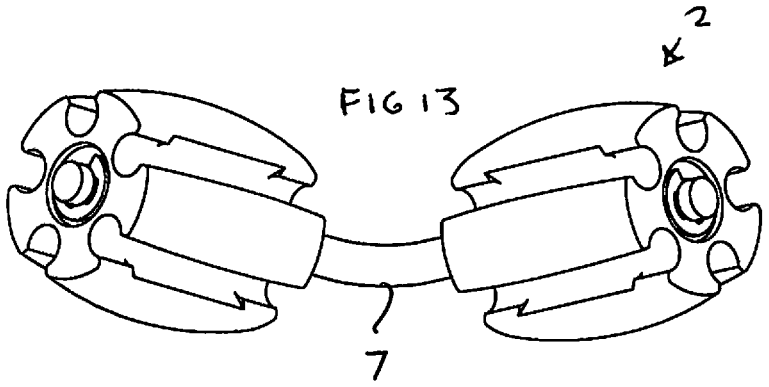
Figure 14:
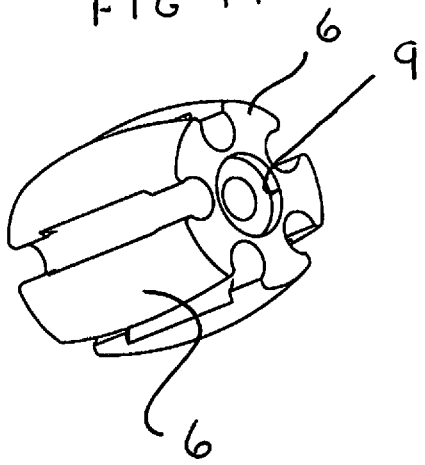
FIG. 14 is a front perspective view of the first embodiment barrel housing.
Figure 15:
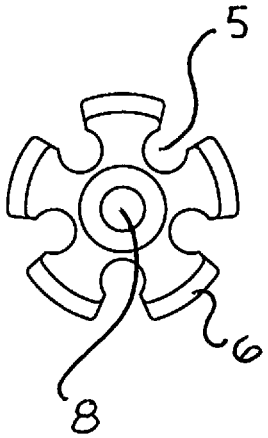
FIG. 15 is an end view of the first embodiment barrel housing.
Figure 16:
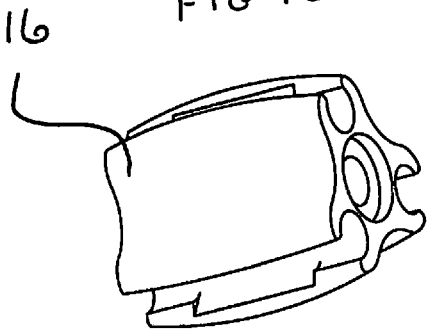
FIG. 16 is a front perspective view of the second embodiment barrel housing.
Figure 17:
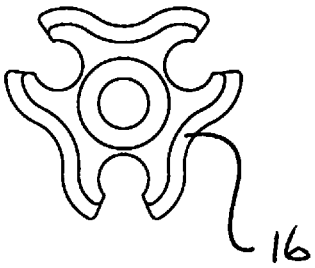
FIG. 17 is an end view of the second embodiment barrel housing.
Figure 18:
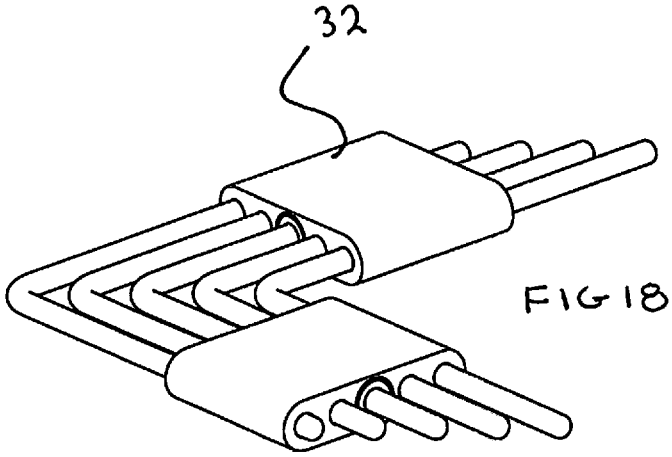
FIGS. 18-20 are rear perspective views of a planar tactile manipulation device.
Figure 19:
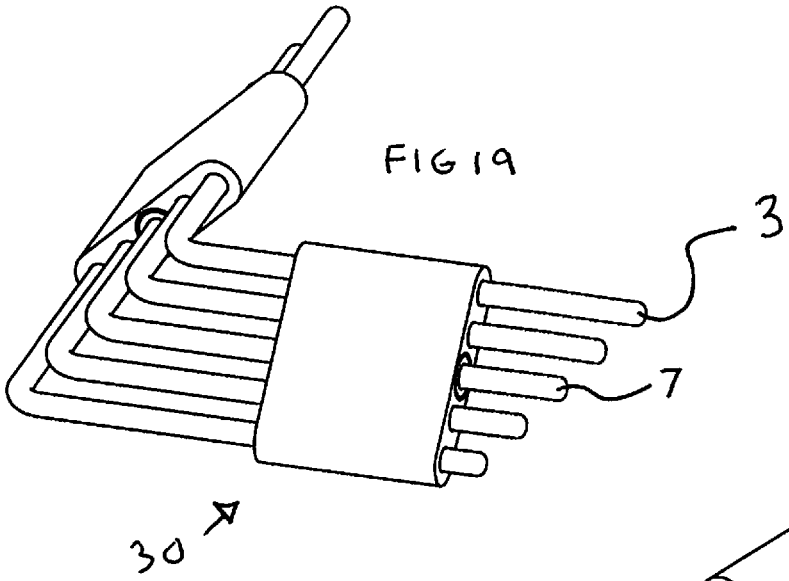
Figure 20:
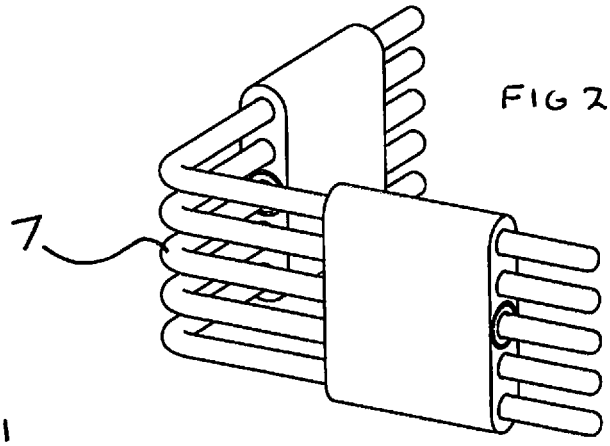
Figure 21:
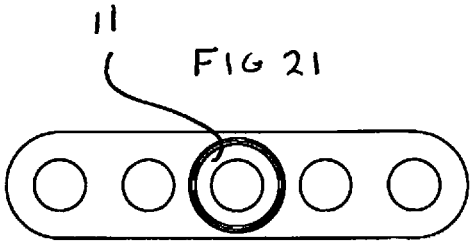
FIG. 21 is an end view of a planar tactile manipulation device.

As illustrated in FIGS. 7-9, the revolve rods 3 may have various end tool bit configurations such as a socket end 20, a screwdriver end 21, a hex bit end 22. The distal and proximal ends of each revolve rod 3 may have different sized rotational tool bit end configurations. There is a plethora of additional rotational tool bits well known in the industry that may be incorporated such as torx bit heads, pentagon bit heads, 12 point bit heads, tamper resistant heads and the like.

Looking at FIGS. 18 to 21 a third, planar embodiment 30 designed to be a tactile toy or fence, rather than a tool is illustrated. It also has an axle rod 7 and four revolve rods 3, however the axle rod 7 is not truncated at the ends of the two planar barrel housings 32 but rather all rods are a substantially similar length. The axle rod 7 is also affixed with circlips 11. Notably, the barrel housing 32 has cylindrical bores for all of the rods (bent or axle) that frictionally captures the rods rather than C-shaped channels 5. This prevents the dislodging of the rods from the barrel housings.

The advantages of the planar embodiment 30, with a central axle rod 7 is that with proper spacing between the planar barrel housings 32, is that the device can be quickly transposed from vertical to horizontal while still retaining the combined strength of the series of bent rods 3. This adaptation offers a plethora of uses.

In operation, the axle rod 7 is the central rod in the planar barrel housings 32. As the planar embodiment is rotated about the axle rod 7 the different sides of the remaining bent rods 3 slide in and out of the cylindrical bores so as to extend at various lengths from the end of the barrel housings.

Figure 22:
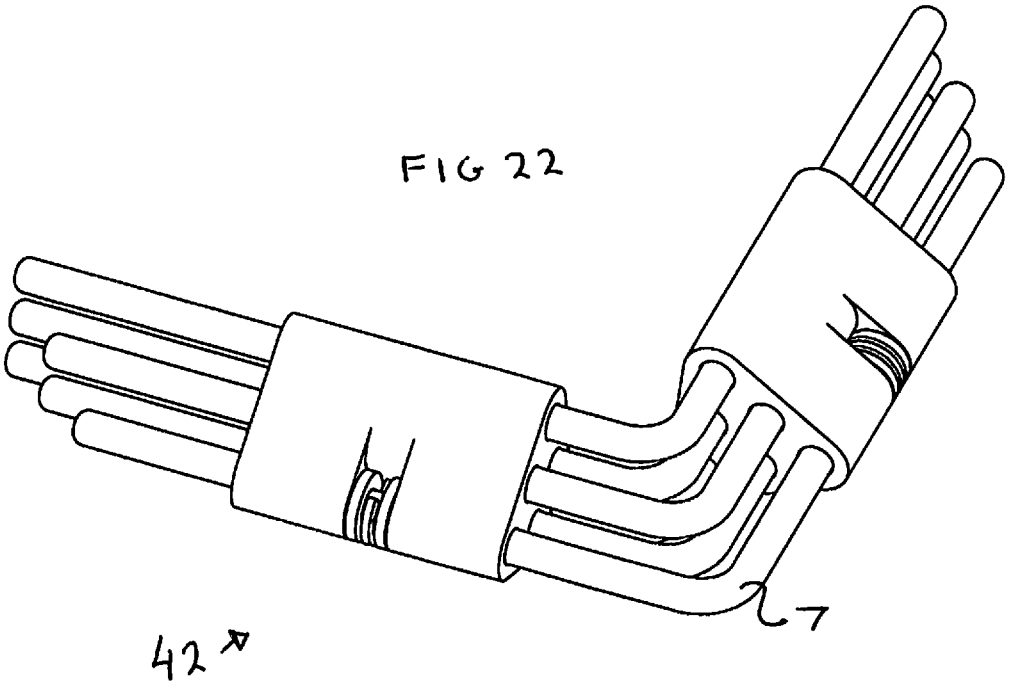
FIG. 22 is a rear perspective view of a triangular tactile manipulation device.
Figure 23:
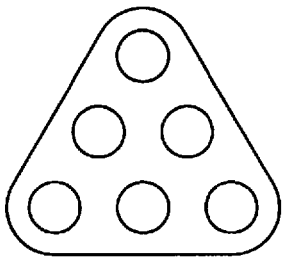
FIG. 23 is an end view of a triangular tactile manipulation device.
Figure 24:
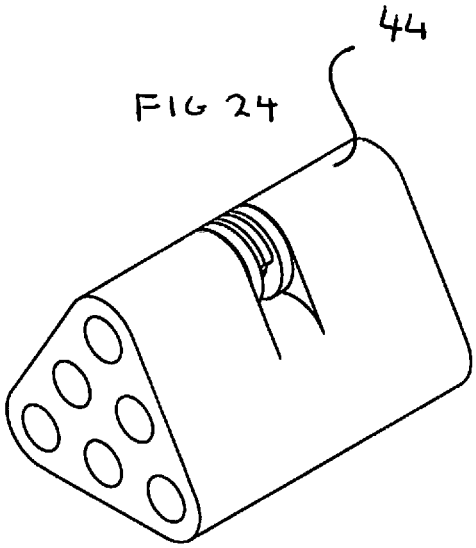
FIG. 24 is an end perspective view of the triangular embodiment barrel.

Looking at FIGS. 22 to 24 a fourth, triangular embodiment 42 designed to be a tactile toy, rather than a tool is illustrated. Here, there are two substantially similar triangular barrel housings 44 with central edge circlip grooves into which circlips 11 are inserted. The axle rod 7 resides in a cylindrical bore adjacent to the edge of the triangular barrel housing 44 with the central edge circlip grooves formed therein.

Figure 25:
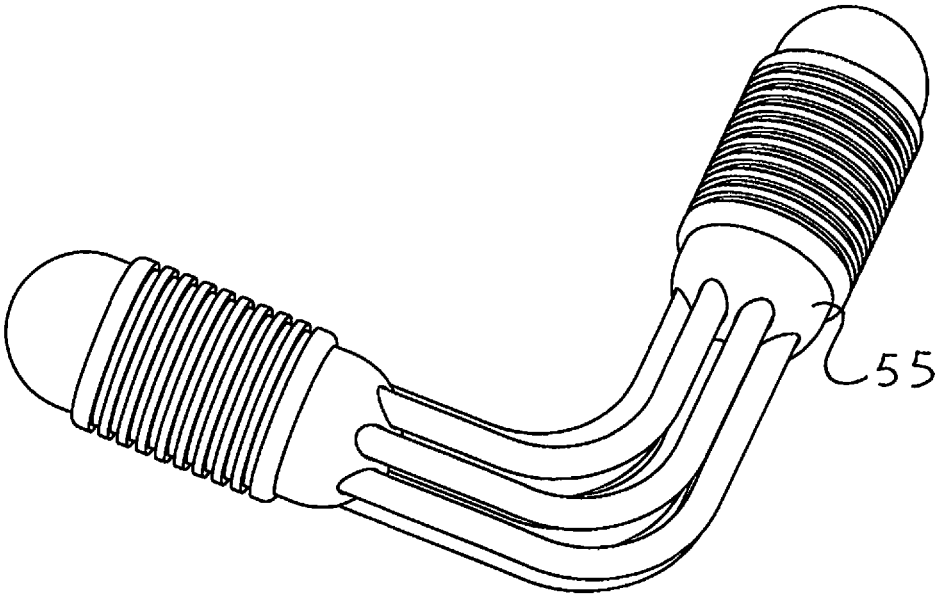
FIG. 25 is a rear perspective view of a cylindrical tactile manipulation device with closed cylindrical barrels.

For aesthetical purposes on toy embodiments, the movement of the ends of the bent rods 3 may be concealed by an extended barrel housing 55 as can be seen in FIGS. 25 to 27.

Any bent rod can become an axle rod 7 by switching the location of the axle bore 8 and its associated circlip grooves 12 from the centerline of the barrel housing to the location of one of the revolve rod bores.

In operation generally, the remaining bent rods 3 in the grouping, revolve around the bent rod designated as the axle rod 7 with their lengths sliding in and out of the barrel housings. The assembly may allow the barrel housing to revolve uniformly about the axle rod 7 or to wobble with a different eccentricity. It provides an interesting visual pattern, and at first look it makes one wonder how the bent rods can rotate.

Although not depicted there may be a sleeve (plain bearing) added on the outside surface of the rods. This sleeve would be a right cylindrical body however its internal recess may bear a different configuration such as square. This would accommodate the use of other cross-sectional configurations of the bent rods such as square tubing. Additionally, to reduce the friction between the bent rods 3 and the barrel housing, a wet or dry lubricant, or surface treatment such as Teflon™ may be applied to either or both of these components. Also, a simple low friction plain bearing or a roller or ball bearing may be inserted between these elements.

It is envisioned that the toy or tool may be sold as a tactile assembly kit or system wherein it would contain multiple bent rods and different angles, multiple axle pins and different barrel housings such that a budding mechanical or structural engineer could envision and build countless machinations. This would be in line with the Erector Sets™ of the past or the current Lego Sets™.

Alternative embodiments may utilize different axis of rotation for the two barrel housings of the same device, I.E. they do not revolve around the same bent rod. This along with the fact that embodiments need not revolve around the central bent rod, result in a plethora of rotatable configurations, each having specific visual effects as well as tactile manipulations. These make the device adept for numerous mechanical uses such as structural imbed anchors and the like.

While certain features and aspects have been described with respect to exemplary embodiments, one skilled in the art will recognize that numerous modifications are possible. Consequently, although several exemplary embodiments are described above, it will be appreciated that the invention is intended to cover all modifications and equivalents within the scope of the following claims.

Having thus described the invention, what is claimed as new and desired to be secured by Letters Patent as follows:

1. A tactile manipulation device, comprising:

at least one bent cylindrical revolve rod;

at least one bent cylindrical axle rod; and a pair of substantially similar resilient barrel housings with a linear axis, said barrel housings having a series of channels and an axle bore formed there through, said channels and axle bore all parallel to said linear axis, wherein said at least one revolve rod is removably and rotationally held within said series of channels in both of said barrel housings, and wherein said axle rod is rotationally held within said axle bore of both said barrel housings.

2. The tactile manipulation device of claim 1 wherein said series of channels are C-shaped channels having an open throat that resides along a length of said barrel housing.

3. The tactile manipulation device of claim 1 wherein said axle bore and said barrel housing have a common centerline.

4. The tactile manipulation device of claim 2 wherein said axle bore and said barrel housing have a common centerline.

5. The tactile manipulation device of claim 1 wherein said C-shaped channels are equally axially spaced about said centerline.

6. The tactile manipulation device of claim 2 wherein said C-shaped channels are equally axially spaced about said centerline.

7. The tactile manipulation device of claim 2 wherein said revolve rods have two ends, said ends having mechanical tools formed thereon.

8. The tactile manipulation device of claim 7 wherein said mechanical tools are selected from the group consisting of screwdriver tips, sockets, hexagonal bit heads, torx bit heads, pentagon bit heads, 12 point bit heads and tamper resistant heads.

9. The tactile manipulation device of claim 1 further comprising at least two retaining means connected between said barrel housing and said axle rod so as to affix said barrel housing at a position along said axle rod.

10. The tactile manipulation device of claim 9 wherein said barrel housing has two ends and a retaining means recess formed in each of said ends, and wherein said axle rod has end retaining means grooves at each end and a pair of intermediary retaining means grooves between said end retaining means grooves, wherein the number of retaining means is 4, said retaining means positioned between said retaining means recesses and said end retaining means grooves and between said retaining means recesses and said intermediary retaining means grooves.

* * * * *